United States Patent [19]

Mowry et al.

[11] Patent Number: 4,641,825

[45] Date of Patent: Feb. 10, 1987

[54] COLLATOR WITH MOVEABLE STITCHER OVER SADDLE CONVEYOR SYSTEM

[75] Inventors: Harry E. Mowry, Plattsburg; Richard B. Hawkes, Peru, both of N.Y.

[73] Assignee: Harris Graphics Corporation, Melbourne, Fla.

[21] Appl. No.: 736,850

[22] Filed: May 22, 1985

[51] Int. Cl.[4] ..... B42B 1/02

[52] U.S. Cl. ..... 270/53

[58] Field of Search ..... 270/54–55, 270/57–58, 53

[56] References Cited

U.S. PATENT DOCUMENTS

| | | | |
|---|---|---|---|
| 1,644,192 | 10/1927 | Kast | 270/53 |
| 3,362,304 | 1/1968 | Suolnick | 270/53 |
| 3,613,217 | 10/1971 | Perkins | 270/53 |
| 3,901,500 | 8/1975 | Gath | 270/53 |
| 4,236,706 | 12/1980 | Schlough | 270/53 |
| 4,479,642 | 10/1984 | Macey | 270/53 |
| 4,489,930 | 12/1984 | Meier | 270/55 |
| 4,555,101 | 11/1985 | Stobb | 270/58 |

FOREIGN PATENT DOCUMENTS

| | | | |
|---|---|---|---|
| 595489 | 4/1960 | Canada | 270/53 |
| 1053467 | 3/1959 | Fed. Rep. of Germany | 270/53 |

*Primary Examiner*—E. H. Eickholt

*Attorney, Agent, or Firm*—Tarolli, Sundheim & Covell

[57] ABSTRACT

A signature collator and stitcher is disclosed which provides high output, multiple path operation, automatic repair, and multispeed operation. The collator provides a saddle conveyor which moves the saddles perpendicular to the direction of the saddles so that the signature assemblies are carried in a direction perpendicular to the fold for better control. The saddles are positioned close to each other so that a high density system results in which high production rates can be obtained with relatively low conveyor speeds. The signature feed delivers the signatures to the saddles along an inclined path to provide a component of movement in the direction of conveyor movement for high speed operation. The stitcher operates on the fly for high speed operation and utilizes a simple linkage to produce linear stitcher head movement. The discharge mechanism includes eccentrically mounted nip rolls so that the throat of the nip rolls moves in the direction of conveyor movement when the signatures are raised into the nip rolls by a tucker blade.

20 Claims, 12 Drawing Figures

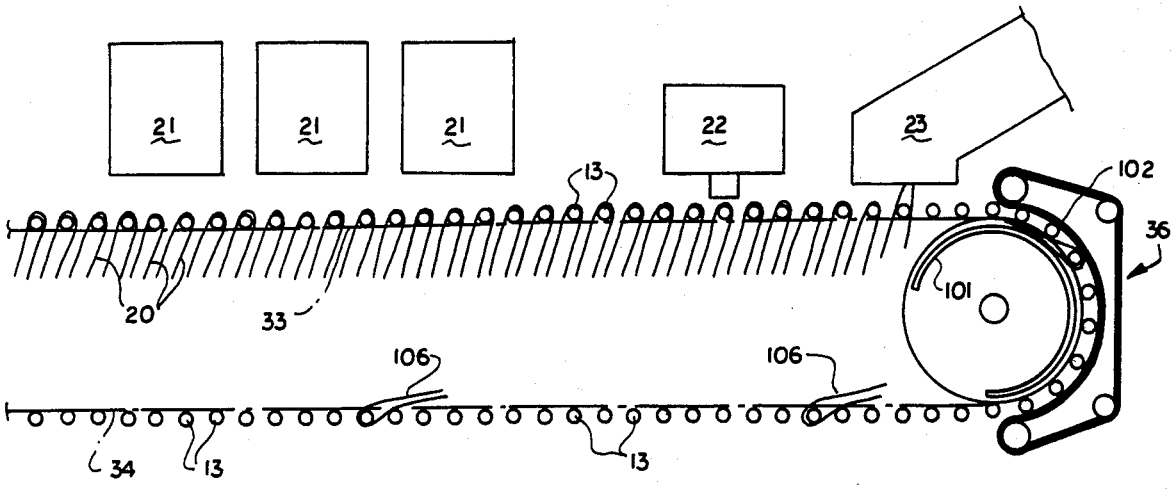
FIG.3
FIG.4a
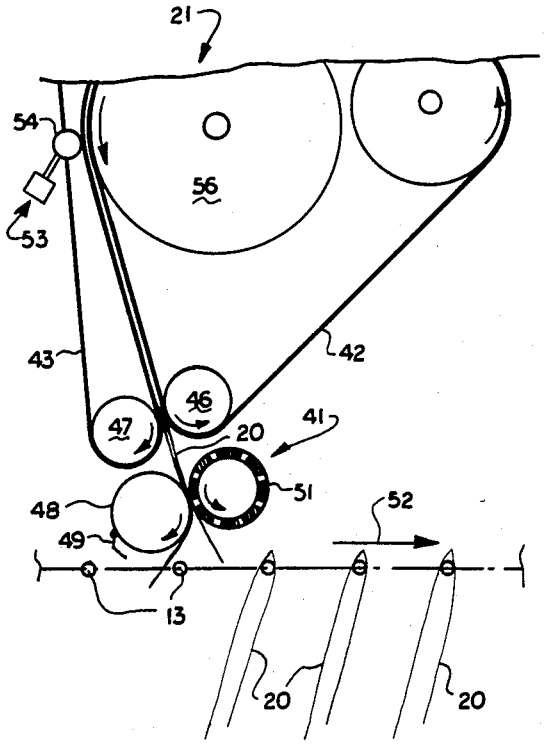
FIG.4b
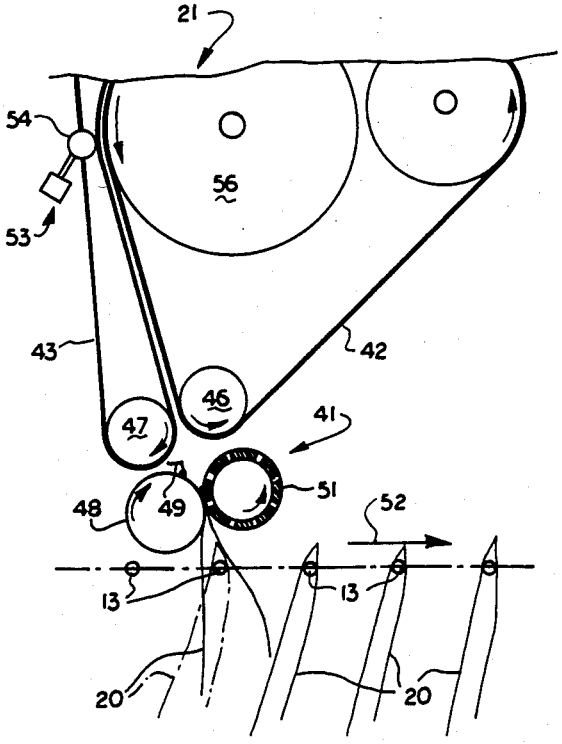

COLLATOR WITH MOVEABLE STITCHER OVER SADDLE CONVEYOR SYSTEM

BACKGROUND OF THE INVENTION

This invention relates generally to collators and more particularly to a novel and improved high speed signature collator which features automatic repair, multiple discharge, and multiple speed operation.

PRIOR ART

Many prior art collators are saddle collators and include a signature conveyor in the form of a closed loop chain conveyor having upper and lower reaches. In such systems, signatures are normally assembled on the upper reach as it moves past the collator hopper or feed stations, and are carried edge first by the conveyor to a stitcher. Examples of such systems are illustrated in U.S. Pat. Nos. 4,196,835 and 4,236,706. Such systems have limited operating speed because the signatures are supported for edge movement in a direction aligned with the fold and tend to flutter.

In some instances, side belts are provided to grip the signatures against the chain for better signature control and to permit higher operating speeds. Such collating systems require relatively high conveyor speeds for a given production rate, and even with belted systems, the production rates are limited.

U.S. Pat. No. 4,200,275 discloses a collator in which the collating conveyor has spaced bars which support signatures along their folds and transport the signatures in a direction perpendicular to the folds, or in the direction of the face of the signature. Again, such systems require high conveyor speeds for high production rates, and cannot provide for automatic repair of a signature group when a feed fails to properly operate.

It is also known to provide newspaper stuffing machines which have a circular conveyor having pockets in which sections of paper are progressively assembled. The sections in such machines are usually supported in the pockets, fold edge down, and are moved in a direction perpendicular to the fold or in the direction of the face rather than in the direction of the edge. Because such machines support sections within pockets and move them in a face direction rather than in an edge direction, high speed operation can be achieved without loss of control of the sections. Such machines, however, are not provided with stitchers and the assembled newspapers are dropped out of the pocket onto one or more discharge conveyor systems. Examples of such machines are illustrated in U.S. Pat. No. 3,825,246 and in pending U.S. patent application Ser. No. 376,278, filed May 10, 1982 assigned to the assignee of the present application.

U.S. Pat. No. 3,825,246 discloses a newspaper stuffer which provides for automatic repair. In such systems, means are provided to detect a misfeed, and when a misfeed occurs at a particular feed station, the downstream feeding stations are shut off as the the pocket at which the misfeed occurred passes the remaining feed stations and until such pocket is again positioned at the particular feeding station where the misfeed occurred. Thereafter, normal feeding occurs, to complete the assembly of the sections. In this way, automatic repair is provided.

In the aforementioned application Ser. No. 376,278 a newspaper stuffer is illustrated which has considerable versatility. Such machine has two operating speeds which are selectively used to provide the desired output required for a particular job. Also, such machine can operate with four different output rates which are selected to provide the most efficient operation for a given job. The machine, however, cannot provide a stitched product.

SUMMARY OF THE INVENTION

There are a number of different aspects to the present invention. In accordance with one important aspect of the invention, an improved collator and stitcher is provided with automatic repair. Such automatic repair is accomplished by providing a conveyor system which is capable of carrying signatures through a full closed loop back to a feed station where a misfeed previously occurred.

There are two embodiments of conveyors illustrated, both of which permit automatic repair. Both embodiments have lateral support bars which extend perpendicular to the direction of conveyor travel and which engage signatures along the fold edge for movement in a direction perpendicular to the fold edge. In one illustrated embodiment, the conveyor has an upper reach and a lower reach. Various feed stations and stitching means are located along the upper reach. In the event of a misfeed, the conveyor is operable to return the particular signature assembly involved to the feed station where the missing signature is being fed by carrying the signature assembly along the lower or return reach of the conveyor.

In another embodiment, the conveyor moves along a substantially horizontal oval course. Such conveyor again has two reaches; however, feed mechanisms are provided along both reaches, so the conveyor need not be as long as in the first embodiment.

In accordance with another aspect of the present invention, the support bars or saddles are located relatively close to each other, i.e., at a distance that is less than the size of the signature measured in the direction perpendicular to the fold, so that high outputs can be achieved without high conveyor operating speeds. For example, if the spacing between adjacent saddles is 5 inches in a collator operable to collate signatures which are 10″×13″ maximum and 5″×7″ minimum and such collator is to operate with single path operation at an output of 20,000 assemblies per hour, the conveyor only has to move about $2\frac{1}{3}$ feet per second.

In accordance with another aspect of this invention, a signature collator is provided with single or multiple collation paths which may be selectively used to provide the most efficient production rate for a given job. Further, the collator provides at least two different operating speeds so that additional outputs may be selected. When the particular job is such that multiple paths can be utilized, and the machine is constructed as discussed above, 20,000 assemblies can be obtained with a collator conveyor speed of about 1.15 feet per second, or if the higher conveyor speed is utilized, higher output rates can be achieved.

Because the signatures are supported on bars or saddles which extend perpendicular to the direction of movement, the saddles maintain proper control and position of the signatures even when the conveyor operates at relatively high speeds. For such high speed operation, however, the feed stations, the stitchers, and the discharge system must also be capable of comparable high speed operation.

In the illustrated embodiment, the feed stations are constructed for high speed operation and are particularly suited for feeding onto the support bars or saddles moving perpendicular to their length. The feed stations operate to feed the signatures open end first, with the folded edge trailing, and provide opening means to open the leading edge of the signatures so that they can move down onto the saddle. Also, the opening means is positioned to maintain feeding control of the signatures even after the leading edges feed down past the saddles. Further, in one embodiment the direction of feed is angulated in the direction of the saddle movement, so the signatures have a component of movement in the direction the saddles move. This facilitates smooth and rapid feeding onto relatively rapidly moving saddles.

The stitching system provides a novel and improved stitcher support which is movable in a reciprocating manner back and forth along the direction of conveyor movement. The stitcher is timed with the movement of the saddles so that the actual stitching operation occurs "on the fly" while the stitcher is moving in synchronism with the saddles. The anvils for the stitchers are carried by a separate endless conveyor positioned on the side of the saddles opposite the stitcher heads. Although the illustrated stitcher system operates to stitch only one signature assembly at a time, the stitcher can be arranged to provide dual stitching head assemblies operable to simultaneously stitch two adjacent signature assemblies and thereby reduce the required cyclic rate of operation of the stitchers.

The delivery or discharge system includes novel and improved nip rolls which operate to move the nip throat in the direction of conveyor movement as the assembled signatures are raised by the tucker blades into the nip throat. Here again, this permits higher speed operation.

These and other aspects of this invention are illustrated in the accompanying drawings and more fully described in the following specification.

BRIEF DESCRIPTION OF THE DRAWINGS

FIG. 3 is a schematic side view of a portion of the collating machine of FIG. 2;

FIGS. 4*a* and 4*b* are fragmentary, schematic views progressively illustrating the operation of the feeding station utilized in the two illustrated embodiments;

DETAILED DESCRIPTION OF THE EMBODIMENTS

Figure 1:
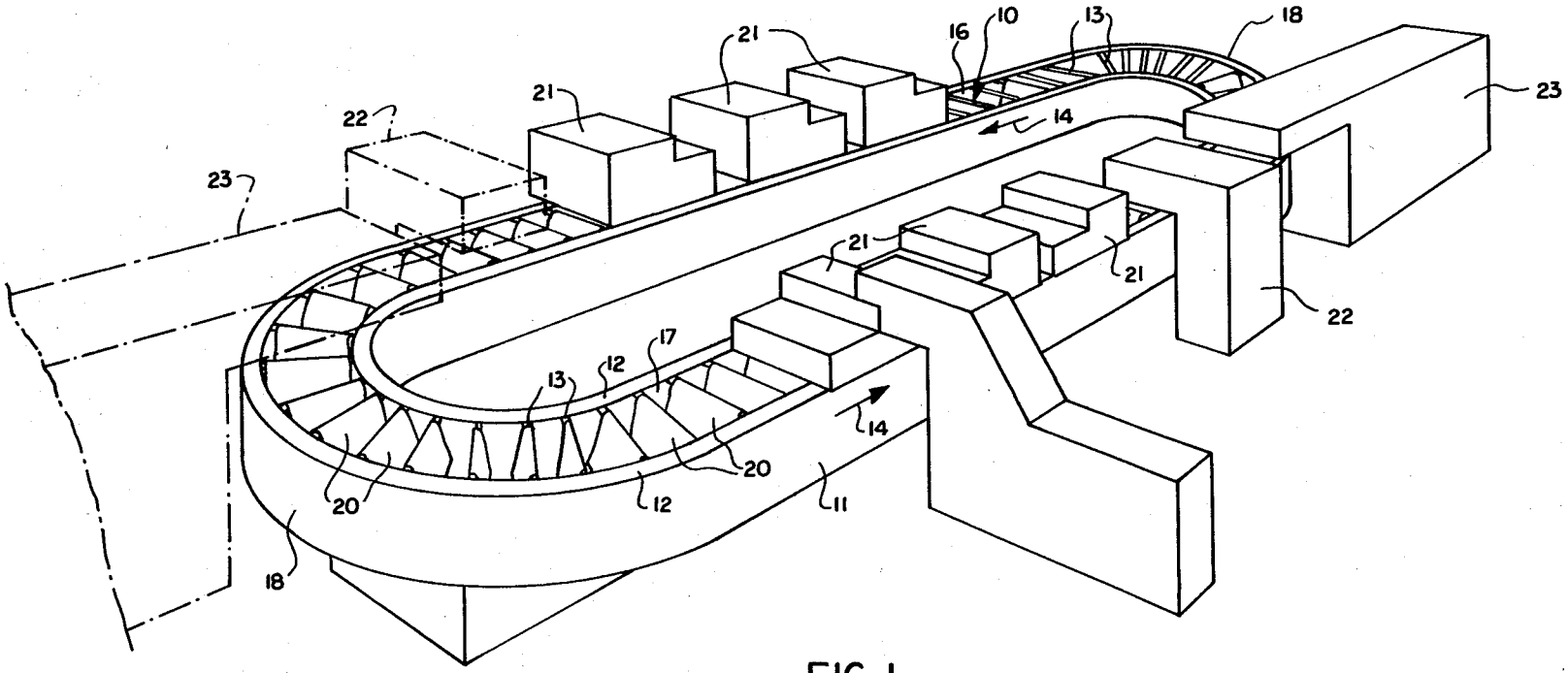
FIG. 1 is a schematic, perspective view of a first embodiment of a collator in accordance with this invention, in which the conveyor is operable to move the saddles along a horizontal oval path.

FIG. 1 is a schematic illustration of the first embodiment of a collator in accordance with this invention. Such embodiment, consisting of an oval conveyor 10, is mounted in the machine frame 11 for horizontal movement along an oval track 12. Mounted at intervals along the conveyor 10 are a plurality of relatively closely spaced support bars or saddles 13 for supporting folded signatures. These saddles extend perpendicular to the direction of movement of the conveyor indicated by the arrow 14.

As illustrated, the conveyor has two parallel, laterally spaced reaches 16 and 17, which are straight and are joined by curved end portions 18, so that the conveyor is a closed loop conveyor which operates to move the saddles or support bars 13 in a direction perpendicular to their length.

Mounted along each of the reaches 16 and 17 are a plurality of signature feeds or hoppers 21 which are schematically represented by blocks in FIG. 1. In the illustrated embodiment, there are three separate signature feeds 21 positioned along the reach 16 and three similar feeds 21 positioned along the reach 17. It should be understood, however, that the number of feeds 21 provided along each reach is determined by the operating requirements of the machine and type of signature assembly being collated and that a greater or lesser number of feeds can be installed in a given machine. The feeds operate to progressively assemble signatures 20 on the saddles 13 as the saddles move therepast.

Downstream from the feed stations 21 on the reach 17 is a stitching assembly 22, and downstream from the stitching assembly 22 is a delivery or discharge mechanism 23. Both the stitching assembly and delivery mechanism are illustrated by block structures in FIG. 1. In machines in accordance with this invention, in which dual paths are provided, an additional stitching assembly 22, illustrated in phantom in FIG. 1, is mounted on the reach 16 downstream from the feed stations 21 thereon. Further, downstream of this stitching assembly is an additional delivery mechanism 23, also illustrated in phantom.

For dual path operation, both of the stitching assemblies 22 and delivery assemblies 23 function. In such operation, signatures 20 are fed from the feed stations 21 along both of the reaches 16 and 17 onto the saddles 13 as the saddles move past the respective feed stations. In the illustrated embodiments, three signatures 20 are sequentially positioned on each saddle along the reach 16 and, similarly, three signatures 20 are sequentially assembled along the saddles 13 of the reach 17. As the assembled signatures are carried by the saddles past the respective stitching assemblies 22, the assembled signatures are stitched and are subsequently removed from the machine by the associated delivery mechanism 23 for transportation to a trimmer and the like.

In the event that the illustrated machine is required to produce signature assemblies including more than three signatures, one of the stitcher assemblies 22 and its associated delivery assembly 23 are deactivated. For example, if the signature assembly and delivery mechanism of the reach 16 are deactivated, signatures are progressively assembled on the saddles moving along the reach 16 and are carried around the curved end portion 18 and then along the reach 17 past the feed stations 21 thereon, where additional signatures 20 are assembled on the saddles. Subsequently, the stitcher assembly 22 and delivery mechanism 23 on the reach 17 operate to stitch the assembled signatures and remove them from the machine. Such single path operation provides half the output for a given conveyor speed, but allows the assembly of twice as many signatures. Where greater outputs are required and the number of signatures in a collated group is not as great, the dual path operation described above is preferably utilized.

As discussed in greater detail below, the illustrated embodiments also provide for variable speed operation and for automatic repair.

Figure 2:
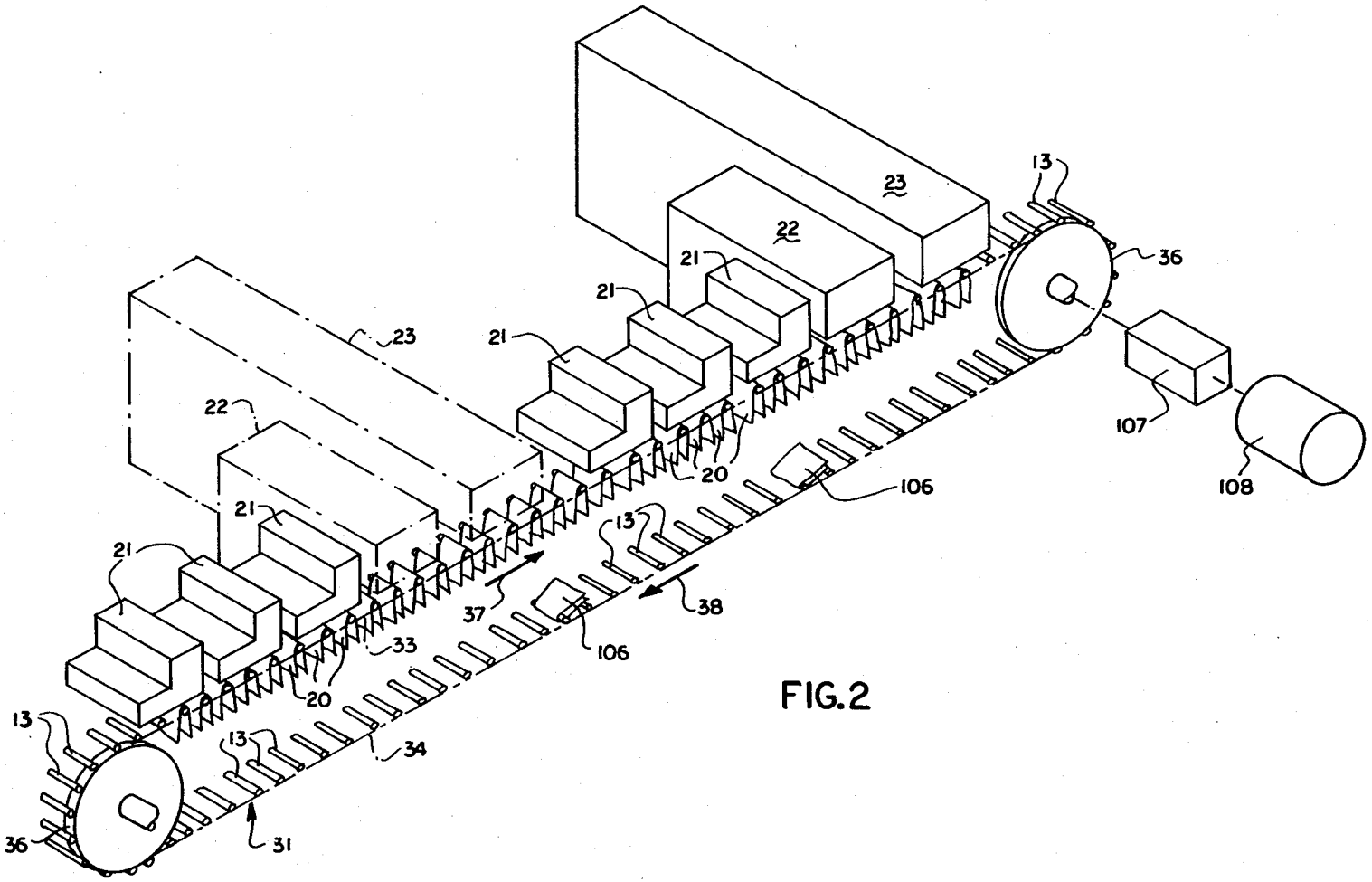
FIG. 2 is a schematic, perspective view of a second embodiment of a collating machine in accordance with this invention, in which the saddle conveyor provides two vertically spaced reaches in which the lower reach is a return reach.

FIGS. 2 and 3 illustrate a second embodiment in which the conveyor provides two reaches which are vertically spaced rather than horizontally spaced, as in the first embodiment. In this embodiment, the conveyor 31 is again provided with closely spaced support rods or saddles 13 which extend perpendicular to the direction of conveyor movement. The conveyor 31 again provides two reaches 33 and 34. However, the reaches 33 and 34 are vertically spaced from each other and are joined by curved conveyor portions 36 at their ends. The upper reach 33 moves in the direction of the arrow 37 and the lower reach moves in the direction of the arrow 38. In this embodiment, all of the feed stations, stitchers, and delivery mechanisms are located along the upper reach.

As best illustrated in FIG. 2, a first group of three feed stations 21 is located at the forward end of the reach 33 and positioned upstream from a first stitcher assembly 22 and a first delivery mechanism 23. Downstream from the first delivery mechanism 23 is a second group of three feed stations 21 and downstream from such group is a second stitcher assembly 22 and delivery assembly 23.

Here again, the machine provides dual path or single path operation. For dual path operation signatures 20 are fed from the feed stations 21 of the first group and are stitched by the first stitcher assembly 22 and then discharged from the machine by the first delivery mechanism 23. While this action is occurring, additional signatures are assembled by the second group of feed stations 21 and are stitched by the second stitching assembly 22 for removal by the second delivery mechanism 23.

Single path operation, however, is provided by deactivating the first stitcher assembly 22 and the first delivery mechanism 23 so that all of the feeders can assemble signatures for stitching by the final stitching assembly 22 and removal by the final delivery mechanism 23.

The embodiment of FIG. 2, as discussed in detail below, is also capable of operating at different speeds for different outputs, and provides for automatic repair in the event that one of the feed stations does not function properly.

FIGS. 4*a* and 4*b* illustrate a preferred hopper or feed station 21 which may be used in either of the illustrated embodiments. In order to simplify the illustration of the invention, FIGS. 4*a* and 4*b* do not include the mechanism for removing individual signatures 20 from the supply hopper and feeding the signatures to the system which transports the signatures to the saddles 13. Various types of signature separating and feeding systems which may be utilized to supply separated signatures to the feed system illustrated are known to those skilled in the art. For example, a signature supply system substantially as illustrated in U.S. Pat. No. 3,809,384 may be utilized to separate the signatures and remove them from the supply hopper. Further, U.S. Pat. No. 3,650,525 illustrates a system which may be utilized for such purpose.

In any event, it is important to provide a system for supplying individual signatures to opening rolls 41 with the fold edge of the signatures trailing and the open edge of the signatures forward. As illustrated in FIG. 4*a*, the signatures 20 are carried down toward the opening rolls 41 by a belt conveyor system including opposed belts 42 and 43, which support and convey a signature 20 therebetween. Such conveyor belts, respectively, extend around rolls 46 and 47 adjacent to the opening rolls 41. The opening rolls 41 receive the signatures 20, open edge first, and include a first roll 48 which is provided with gripper fingers 49 that grip the forward edge of one side of the signature.

In order to facilitate this gripping action, each of the signatures 20 is folded in such a way that the side of the signature adjacent to the roll 48 extends beyond the forward edge of the other side of the signature to leave an exposed forward edge along only one side of the signature which is gripped by the gripper fingers 49.

The other roll 51 of the opening roll is a vacuum roll 51 which cooperates with the gripper fingers to cause the forward edges of the signature to be opened as they pass through the opening rolls 41. The diameters of the rolls 48 and 51 are preferably small so that the rearward edge of the signature is retained between the rolls for gripping and conveying purposes after the forward open edge of the signature is positioned over the adjacent saddles 13. This is the condition illustrated in FIG. 4*b* wherein the signature 20 is positively carried by the rolls 41 down over the adjacent saddle a considerable amount before the signature becomes released by the opening rolls. With this structure, in which positive control of the signature is maintained until the signature is partially positioned over the saddle, a high speed operation is achieved.

The conveyor belts 42 and 43 and the opening rolls 41 are arranged so that the signatures are fed along a downward path inclined in the direction of saddle movement as indicated by the arrow 52. By providing this component of movement, it is possible to smoothly feed signatures onto saddles even when the saddles are moving at a relatively fast rate. Preferably, the timing of the system is such that the saddle 13 on which the signature is being positioned is approaching a position in direct alignment with the feed system but not yet to such position, as illustrated in FIG. 4*a*, when the signature which has been opened initially feeds down over the saddle. The timing is further preferably arranged so that when the signature is released by the rolls 41, the saddle 13 is substantially in alignment with the throat of the feed system, as illustrated in FIG. 4*b*. With this timimg, high operating rates can be achieved in a reliable manner.

The feed stations 21 are provided with a caliper sensing system 53 comprising a sensing roller 54 which is positioned against the surface of a feed roll 56 and operates to determine that a proper feed is occurring. Such caliper is arranged to sense the absence of a signature and to produce one signal in that event, and to sense the presence of one or more signatures and to produce other signals corresponding to such conditions. These signals are used to control the subsequent operation of the collator so as to provide automatic repair, as discussed in detail below.

Figure 5:
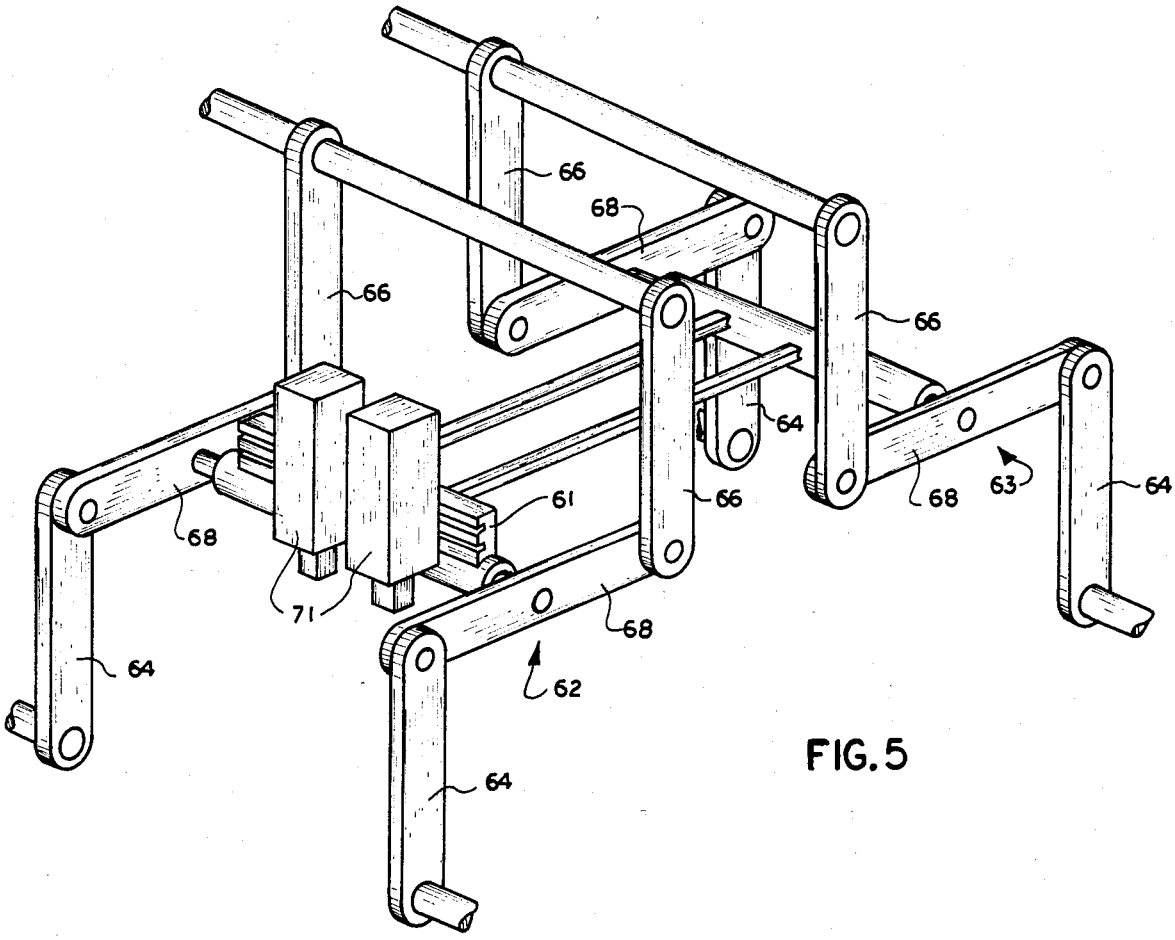
FIG. 5 is a schematic, fragmentary, perspective view of the stitcher heads and reciprocating support therefor.
Figure 5A:
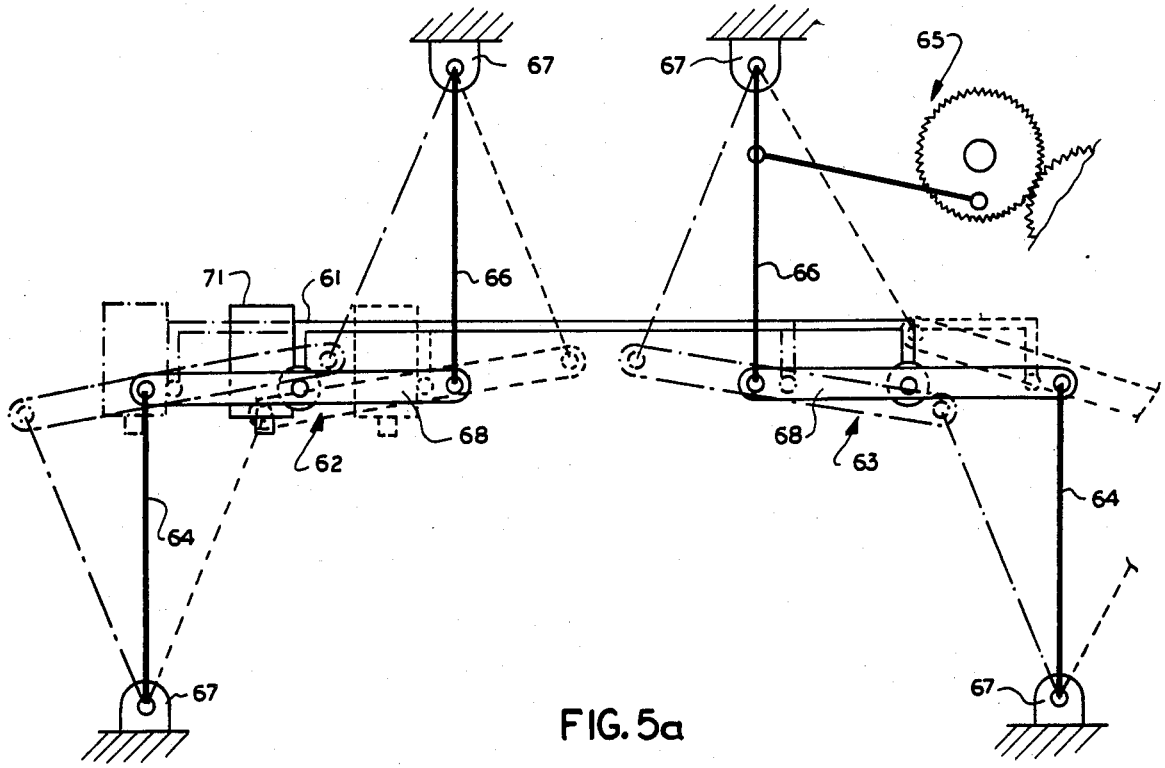
FIG. 5*a* is a schematic side elevation illustrating the operation of the stitcher head support linkage which produces straight-line reciprocation.
Figure 5B:
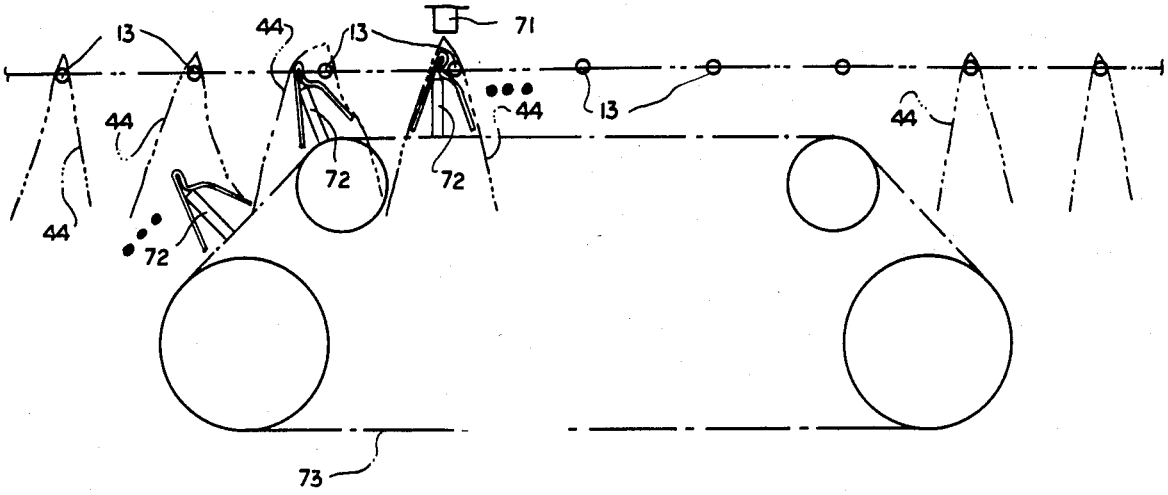
FIG. 5*b* schematically illustrates the stitcher anvil or crimper system.

FIGS. 5 through 5*b* illustrate the structure and operation of a preferred stitching assembly in accordance with this invention. As best illustrated in FIGS. 5 and 5*a*, the stitcher includes a stitcher base 61 supported on similar but opposite linkages 62 and 63. Each of the linkages includes a pair of support links 64 and 66 pivoted at one end on a support frame 67 and at the other end on a connector link 68. The various links 64, 66, and 68 are proportioned so that the links 64 and 66 are identical in length and parallel to each other, and the carrier link 68 extends perpendicular to the associated links 64 and 66 when the linkages are in a mid-position. The stitcher base 61 is pivotally connected to each of the carrier links 68 and 69 midway between their pivotal connections with the links 64 and 66. With this structure, the linkage produces straight-line movement of the stitcher base 61 back and forth when the linkages are caused to reciprocate in both directions from the neutral position as illustrated in FIG. 5*a*. Reciprocation of the linkage may be provided in any number of ways; however, as illustrated, it is preferred to provide a gear-driven crank and pitman drive 65 driven from the conveyor drive system and connected to reciprocate the stitcher base in timed relationship to the operation of the conveyor.

Mounted on the stitcher base 61 are a plurality of stitcher heads 71 which receive wire and operate to bend the wire and staple the assembled signatures along their fold. Such stitcher heads work in combination with crimpers or anvils 72 carried by an endless conveyor 73 which is mounted below the saddles, as illustrated in FIG. 5*b*. The operation of the conveyor 73 is timed with the operation of the saddle conveyor 10 so that the anvils 72 are raised up along the open end of the signatures and lift the signatures 44 off the associated saddle and to position the folds of the signatures for stapling by the stitching heads. The conveyor 73 is timed with the operation of the main conveyor so that the anvils move in a synchronized relationship with the saddles 13 and also in a synchronized manner with the reciprocating movement of the stitcher support and stitchers. Because the stitcher operates on the fly, high speed operation can be achieved. Also, it is within the broader aspects of this invention to provide two banks of stitcher heads 71 on the stitcher base 61 so that two signature assemblies are stapled at the same time. With such a structure, the cyclic rate of reciprocation of the stitcher base can be cut in half for a given output.

Figure 6C:
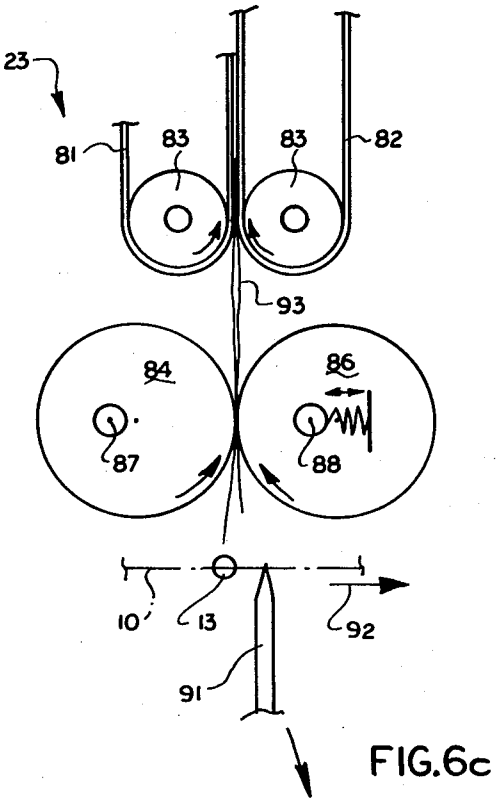
FIGS. 6*a* through 6*c* are schematic illustrations of the delivery or discharge system progressively illustrating its operation.
Figure 6B:
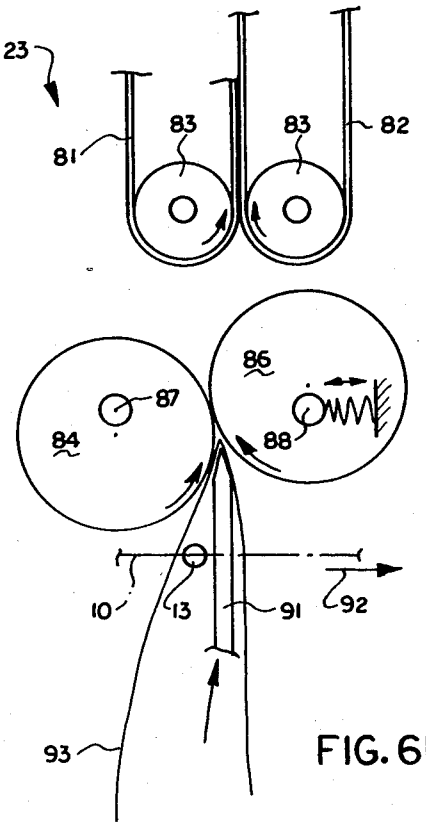
Figure 6A:
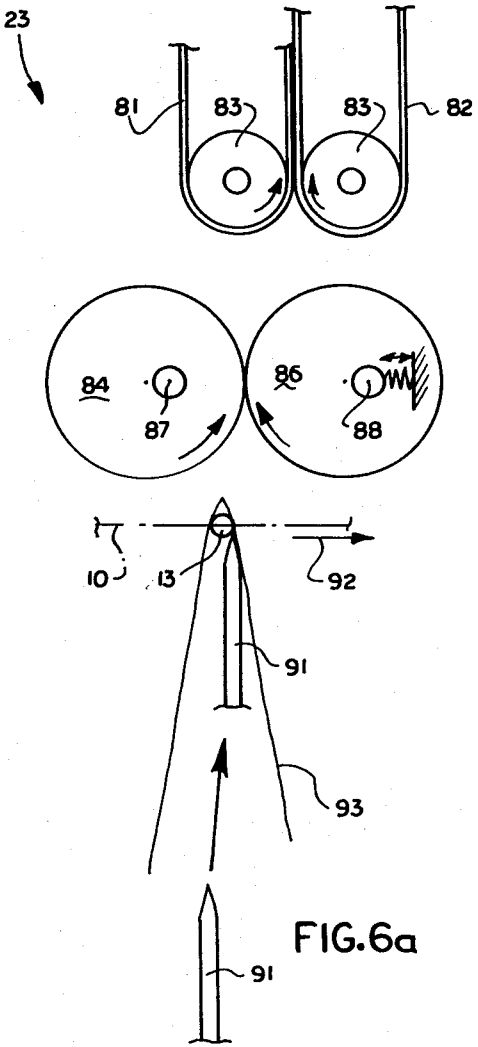

FIGS. 6*a* to 6*c* schematically illustrate the structure and operation of the discharge or delivery mechanism 23. Such mechanism includes a pair of opposed conveyor belts 81 and 82 which extend around pulleys 83 and provide abutting reaches which operate to convey the signature assembly from the machine. Located immediately below the pulleys 83 are a pair of nip rolls 84 and 86 which are journaled for rotation about eccentric pivots 87 and 88, respectively. The roller 84 is driven and rotates about a fixed pivot axis and the pivot of the other roller is spring-biased so as to maintain the two rollers in contact.

Positioned below the nip rolls is a tucker blade 91 which operates to engage the stitched signature assembly being carried past the delivery mechanism by the associated saddle 13 and to lift the signature assembly up so that the fold is inserted into the throat between the nip rolls. The nip rolls then operate to feed the assembled signatures up between the adjacent belts 81 and 82 for removal from the machine.

Because the nip rolls are journaled on eccentric pivots, the throat defined by the interengagement of the rolls moves back and forth in a direction generally parallel to the direction of conveyor movement indicated by the arrow 92. Further, the tucker blade 91 is supported on a suitable drive system, such as planetary gearing or a linkage, so that as the signature assembly 93 is carried by the saddle 13 through the delivery mechanism 23, the tucker blade moves with the saddles and raises up and engages the fold of the signature assembly 93. The tucker blade then lifts the assembled signatures 93 off the saddle and positions the fold within the throat of the nip rolls, as illustrated in FIG. 6*b*. The rotation of the nip rolls is timed so that as the mechanism moves from the position of FIG. 6*a* to the position of FIG. 6*b*, the throat between the nip rolls moves with the saddle to the right as viewed in the drawings, and is positioned to receive the fold of the signature assembly as it is raised into the throat by the tucker blade 91.

After the tucker blade functions to position the signature assembly within the nip rolls, the various components reach the position of FIG. 6*c*, where the tucker blade 91 has already started to drop down below the associated saddle, and the signature assembly has been fed upward by the nip rolls into the throat between the two conveyor belts 81 and 82 for movement out of the machine. The various components of the system are preferably structured and timed so that the throat of the nip rolls is aligned with the throat between the belts at the point when the signatures reach the throat of the conveyor belts.

The nip rolls at the beginning of the cycle of operation illustrated in FIG. 6*a* are located to the left, as illustrated in the drawings, and are displaced from a position in alignment with the throat of the conveyor belts 81 and 82. As the operation continues, the throat between the nip rolls moves with the saddle 13 while the signatures are initially gripped as illustrated in FIG. 6*b* and continue such movement and are aligned with the throat of the belts 81 and 82 when the position of FIG. 6*c* is reached. Consequently, the nip rolls also operate "on the fly" to grip and remove the signatures, and therefore accommodate high speed operation.

Figure 7:
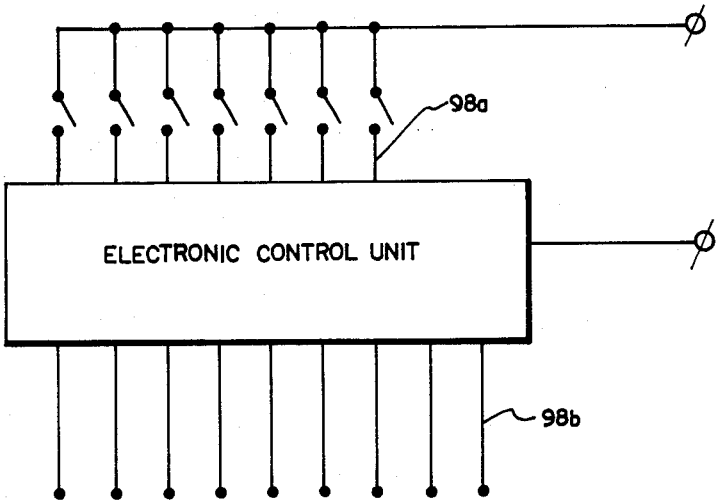
FIG. 7 schematically illustrates a control circuit for effecting automatic repair.

Both of the embodiments illustrated are operable to provide automatic repair in the event that one of the feed stations fails to feed a particular signature, causing that particular assembly to be incomplete. As illustrated in FIGS. 4*a* and 4*b*, the feed stations are provided with a caliper 53 having a roller 54 which is mounted on a switching or signal generating device 98 and rolls along the roll 56. When a signature is properly fed along the roll 56 past the rollers 54, such roller is moved laterally away from the roller or drum 56 and produces a signal indicating that proper feed has occurred. Such movement is not produced, and another signal results, when a misfeed occurs and the signature is not passed down to the saddle. The caliper, therefore, generates a signal which determines whether or not a signature is properly being fed into the assembly. A control circuit for effecting automatic repair is shown schematically in FIG. 7. The control circuit comprises an electronic control unit, a plurality of caliper switches 98*a* the number of which corresponds to the number of feed stations 21 and which are located at the feed stations. The control circuit also includes a plurality of disabling outputs 98*b* for disabling the feed stations, stitcher and delivery means.

If a signal is generated indicating that proper feeding has occurred, the machine continues to operate in a normal manner. However, if the caliper generates a signal indicating that proper feeding has not occurred, a respective caliper switch 98*a* is actuated actuating the electronic control unit which effects actuation of respective disabling outputs 98*b* so that the subsequent feed stations are deactivated along with the following stitcher and delivery mechanisms as the incomplete assembly passes each such subsystem. Consequently, the incomplete signature assembly is carried around the machine until it reaches the feed station feeding the missing signature. At that time, such feed station supplies the missing signature. The respective caliper 53 generates a signal indicating a proper feed that deactuates the respective caliper switch and the electronic control unit, and the machine again operates in the normal way to complete the assembly, which is then stapled and discharged in a normal manner.

If the machine is operated as a single path machine, the incomplete assembly is carried back to the same feed station which earlier functioned improperly, and the missing signature is supplied. In the event that the machine is operating with a double path operation, the downstream feeds, stitchers, and delivery systems are deactivated until the incomplete signature reaches that feed system on the other path which is feeding the missing signature.

Both conveyor systems are capable of carrying incomplete signatures around to a point where the missing signature can be installed. In the embodiment of FIG. 1, in which the saddles 13 move along a horizontal oval path, incomplete signature assemblies are merely carried around the curved end portions.

Referring to FIG. 3, the conveyor 31 of the second embodiment includes upper reaches and lower reaches 33 and 34, respectively. In this embodiment, a guide 101 is positioned adjacent to the curved end 36 along which the saddles move from the upper reach 33 to the lower reach 34. When automatic repair is required, this guide engages an incomplete signature assembly carried past the deactivated stitcher 22 and delivery mechanism 23. The guide 101 causes the open end of the signature to trail the associated saddle as the saddle moves down around the curved end portion 36, so that after the saddle reaches the lower reach 34, the incomplete signature assembly 106 lies back over the adjacent saddles as it moves along the lower reach. To assist in controlling the position of the incomplete assembly, a belt 102 is positioned to extend around the saddles moving along the curved portion.

The various operating mechanisms of the machine in accordance with this invention are timed together in their operation, usually by gear trains and the like. However, since such systems are known to those skilled in the art, they have not been illustrated herein.

The drive for the machine provides for variable speed operation. Such operation is obtained by a transmission 107 connected between the machine drive motor 108 and the machine, as schematically illustrated in FIG. 2. The transmission 107 may take a plurality of forms. One form of a two-speed transmission suitable for the drive of the collator according to the present invention is disclosed in aforementioned application Ser. No. 376,278, now U.S. Pat. No. 4,477,067.

Because the signatures are carried in a face direction perpendicular to the fold, good control of the signatures is maintained even when the conveyor operates at relatively high speeds. Further, high outputs are obtained by a collator in accordance with this invention without excessive conveyor speeds because the saddles are positioned relatively close together. In fact, the spacing between the saddles is preferably less than the fold length of the largest size signature that can be handled with the machine. For example, saddles can be positioned at about 5 inches on center and yet handle signatures which have a fold length in the order of 13 inches. Because the saddles are closely spaced, a given output of the machine can be obtained with slower conveyor speeds than would be required if greater saddle spacing were utilized.

The preferred machine in accordance with this invention has improved versatility and high output. It provides automatic repair, allows for varying operating speeds, and can operate with a multipath operation or with single path operation.

Although the preferred embodiments of this invention have been shown and described, it should be understood that various modifications and rearrangements of the parts may be resorted to without departing from the scope of the invention as disclosed and claimed herein.

What is claimed is:

1. A collator comprising a closed loop endless conveyor including a plurality of signature supporting means extending perpendicular to the conveying direction, a plurality of signature feed means adjacent said conveyor operable to progressively locate folded signatures in position supported by said signature supporting means to produce assemblies of signatures in which the folds thereof extend perpendicular to the conveying direction, stitching means adjacent to said conveyor operable to stitch together assembled signatures delivered thereto by said signature supporting means, and delivery means operable to remove stitched assemblies from said conveyor, said signature feed means including a sensor operable to detect when a misfeed occurs resulting in an incomplete assembly, said sensor operating to disable downstream signature feed means as well as stitching means and delivery means as said incomplete assembly passes thereby, said conveyor operating to return said incomplete assembly to a feed means feeding the missing signature for subsequent completion, stitching, and removal from said conveyor.

2. A collator as set forth in claim 1 wherein said signature feed means operates to feed a folded signature folded edge trailing along a path inclined at an acute angle in the direction of movement of said signature supporting means, said feed means including opening means operable to open the leading edge of said signature as it reaches the associated supporting means.

3. A collator as set forth in claim 2, wherein said feed means maintains full control of said signatures until after the leading edges thereof are substantially past the associated supporting means.

4. A collator comprising a closed loop conveyor providing saddles at intervals along the length thereof extending perpendicular to conveyor travel, a plurality of feeders operable to progressively position folded signatures on said saddles with the signature folds supported on the saddles, stitcher means operable on the fly to stitch assembled signatures, and discharge means providing nip rolls providing a throat reciprocable along a path substantially parallel to the direction of conveyor movement, said discharge means comprising a tucker blade operable to move assembled signatures from a supporting saddle into said throat.

5. A collator as set forth in claim 4, wherein said nip rolls are journaled on eccentric axes to cause said throat to move with reciprocating movement generally in the direction of conveyor movement.

6. A collator comprising a closed loop conveyor providing saddles at intervals along the length thereof extending perpendicular to conveyor travel, a first group of feeders, a second group of feeders, a separate stitcher positioned along said conveyor downstream from each of said groups of feeders, a separate delivery mechanism positioned adjacent to said conveyor downstream from each stitcher, said collator being operable for dual path operation in which each group of feeders cooperates with the adjacent downstream stitcher and delivery mechanism to complete assembled signatures, said collator being operable with single path operation by disabling one of said stitchers and its associated discharge mechanism whereby signatures assembled by all of said feeders are stapled by the other stitcher and discharged by the other discharge mechanism.

7. A collator as set forth in claim 6 including a drive operable to drive said conveyor, feeders, stitchers, and discharge mechanisms at at least two different operating speeds.

8. A collator for folded signatures measured perpendicular to the fold, said collator comprising a closed loop conveyor havng a plurality of saddles at uniform intervals theralong, said saddles extending perpendicular to the direction of conveyor movement and being operable to support said signatures along their folds, said saddles being spaced from each other by a distance less than the size of a signature measured in the direction perpendicular to the fold, a plurality of signature feeders positioned adjacent said conveyor operable to progressively position signatures on said saddles as said saddles progress past said feeders to produce signature asemblies, and stitcher means operable to stitch said signature assemblies as they are carried past said stitcher means by said saddles, said stitcher moving with said saddles as said signatures are stitched, said stitcher including stitcher heads mounted on a support driven for reciprocation in timed relation to the movement of said saddles, said support being guided for straight-line reciprocating movement in a direction parallel to saddle movement by pairs of similar linkages.

9. A collator as set forth in claim 8, wherein discharge means is provided which include nip rolls providing a throat that moves in the direction of saddle movement, and tucker means operable to move the assembled signatures from an associated saddle into said throat as said throat moves with said saddle.

10. A collator for folded signatures measured perpendicular to the fold, said collator comprising a closed loop conveyor having a plurality of saddles at uniform intervals therealong, said saddles extending perpendicular to the direction of conveyor movement and being operable to support said signatures along their folds, said saddles being spaced from each other by a distance less than the size of the signatures meaured in the direction perpendicular to the fold, a plurality of signature feeders positioned adjacent said conveyor operable to progressively position signatures on said saddles as said saddles progress past said feeders to produce signature assemblies, stitcher means operable to stitch said signature assemblies as they are carried past said stitcher means by said saddles, discharge means which include nip rolls providing a throat that moves in the direction of saddle movement, and tucker means operable to move the asembled signatures from an associated saddle into said thorat as said throat moves with said saddle.

11. A collator as set forth in claim 10, wherein said nip rolls are journaled on eccentric axes to cause said throat to reciprocate generally in the direction of saddle movement.

12. A collator comprising a closed loop endless conveyor including a plurality of signature supporting means extending perpendicular to the conveying direction, a plurality of signature feed means adjacent said conveyor operable to progressively locate folded signatures in position supported by said signature supporting means to produce assembies of signatures in which the folds thereof extend perpendicular to the conveying direction, stitching means adjacent to said conveyor operable to stitch together assembled signatures delivered thereto by said signature supporting means, and delivery means operable to remove stitched assemblies from said conveyor, said conveyor including upper and lower reaches joined by curved end portions, and guide means for controlling signature movement along at least one of said curved end portions.

13. A collator as set forth in claim 12, wherein said guide means are located at the descending curved end portion along which said signature supporting means move from said upper reach to said lower reach, said guide means extending along the path of said conveyor and operating to cause the open edge of said signatures to trail as the signature supporting means associated therewith move down along said descending curved end.

14. A collator for folded signatures measured perpendicular to the fold, said collator comprising a closed loop conveyor having a plurality of saddles at uniform intervals therealong, said saddles extending perpendicular to the direction of conveyor movement and being operable to support said signatures along their folds, said saddles being spaced from each other by a distance less than the size of a signature measured perpendicular to the fold, a plurality of signature feeders positioned adjacent said conveyor operable to progessively position signatures on said saddles as said saddles progress past said feeders to produce signature assemblies, and stitcher means operable to stitch said signature assembies as they are carried past said stitcher means by said saddles, said collator further comprising anvil means carried by an endless conveyor mounted below said closed loop conveyor, said anvil means comprising a plurality of anvils corresponding to said plurality of saddles.

15. A collator as set forth in claim 14, wherein said feeders operate to feed signatures toward said saddles folded edge trailing and operate to open said signatures as they reach said saddles.

16. A collator as set forth in claim 15, wherein said feeders maintain control of said signatures until after the open edge thereof is past said saddles.

17. A collator as set forth in claim 16, wherein said feeders feed signatures along a path inclined in the direction of conveyor movement to facilitate movement of said signatures onto said saddles.

18. A collator as set forth in claim 17, wherein said stitcher means moves with said saddles as said signatures are stitched.

19. A collator for folded signatures measured perpendicular to the fold, said collator comprising a closed loop conveyor having a plurality of saddles at uniform intervals therealong, said saddles extending perpendicular to the direction of conveyor movement and being operable to support said signatures along their folds, said saddles being spaced from each other by a distance less than said dimension, a plurality of signature feeders positioned adjacent said conveyor operable to progressively position signatues on said saddles as said saddles progress past said feeders to produce signature assemblies, and stitcher means operable to stitch said signature assemblies as they are carried past said stitcher means by said saddles, said stitcher means being movable with said saddles as said signatures are stitched.

20. A collator as set forth in claim 19, wherein said stitcher means includes stitcher heads mounted on a support driven for reciprocation in timed relationship to the movement of said saddles.

* * * * *